US010748753B2

(12) United States Patent
Mous

(10) Patent No.: US 10,748,753 B2
(45) Date of Patent: Aug. 18, 2020

(54) ACCELERATOR MASS SPECTROMETRY SYSTEM AND ASSOCIATED METHOD

(71) Applicant: High Voltage Engineering Europa B.V., Amersfoort (NL)

(72) Inventor: Dirk Jozef Willem Mous, Amersfoort (NL)

(73) Assignee: HIGH VOLTAGE ENGINEERING EUROPA B.V., Amersfoort (NL)

( * ) Notice: Subject to any disclaimer, the term of this patent is extended or adjusted under 35 U.S.C. 154(b) by 0 days.

(21) Appl. No.: 16/439,817

(22) Filed: Jun. 13, 2019

(65) Prior Publication Data

US 2019/0385830 A1 Dec. 19, 2019

(30) Foreign Application Priority Data

Jun. 14, 2018 (EP) ..... 18177774

(51) Int. Cl.
*H01J 49/00* (2006.01)
*H01J 49/30* (2006.01)

(52) U.S. Cl.
CPC ..... *H01J 49/0086* (2013.01); *H01J 49/305* (2013.01)

(58) Field of Classification Search
CPC ..... H01J 49/00; H01J 49/004; H01J 49/0031; H01J 49/0027; H01J 49/0081; H01J 49/0086; H01J 49/02
(Continued)

(56) References Cited

U.S. PATENT DOCUMENTS 5,569,915 A * 10/1996 Purser ..... H01J 49/0086 250/281
5,783,823 A * 7/1998 Mous ..... H01J 49/0086 250/281

(Continued)

OTHER PUBLICATIONS

European Search Report for the European Patent Application No. EP18177774, dated Dec. 20, 2018, 5 pages.

(Continued)

*Primary Examiner* — Jason L McCormack

(57) ABSTRACT

An accelerator mass spectrometry system for measuring an isotopic ratio of a chemical element in a sample. The system includes an ion source generating a beam of negative ions of the chemical element containing ions of first and second isotopes of the chemical element, a first analyzer section, comprising a first mass analyzer; a tandem accelerator comprising a first accelerating section, a charge stripping section for converting the negative ions into positive ions, and a second accelerating section behind the charge stripping section. A second analyzer section includes a second mass analyzer and an electrostatic analyzer; a particle detector; and a controller system configured to control the first mass analyzer section and the second analyzer section such that the ions of the first and second isotopes traverse the tandem accelerator and ions of only one of the first and second isotopes enter the particle detector. An additional analyzer is located in between the charge stripping section and the second accelerating section and is configured to receive positive ions that have exited the charge stripping section and to separate positive ions having a charge state corresponding to a predetermined charge-state value from positive ions having a charge state not corresponding to the predetermined charge-state value, so as to transmit ions with different charge states in mutually different directions such that only ions having a charge state corresponding to the (Continued)

predetermined charge-state value are transmitted towards the particle detector.

16 Claims, 2 Drawing Sheets

(58) Field of Classification Search
USPC ..... 250/281, 282
See application file for complete search history.

(56) References Cited

U.S. PATENT DOCUMENTS

2006/0292058 A1* 12/2006 Reden ..... H01J 37/3171
423/447.2
2018/0082828 A1* 3/2018 Jiang ..... H01J 49/48

OTHER PUBLICATIONS

Steinhof et al., "A 82KR Pilot Beam for the Accelerator Mass Spectrometry of 41CA", Nuclear Instruments & Methods in Physics Research. Section B: Beam Interactions with Materials and Atoms, Elsevier BV, NL vol. B52, No. 3/04, Dec. 2, 1990 (Dec. 2, 1990), pp. 391-397, XP000178398, ISSN: 0168-583X, DOI: 10.1016/0168-583X (90) 90444-Y.

* cited by examiner

ACCELERATOR MASS SPECTROMETRY SYSTEM AND ASSOCIATED METHOD

CROSS-REFERENCE TO RELATED APPLICATIONS

This application claims priority to European Patent Application Serial No. 18177774.9, filed Jun. 14, 2018, tilted "Accelerator Mass Spectrometry System and Associated Method," the entire contents of which application are incorporated herein by reference.

FIELD OF THE DISCLOSURE

The present invention relates to an accelerator mass spectrometry system for measuring an isotopic ratio of a chemical element in a sample. Furthermore, the present invention relates to a method for measuring an isotopic ratio of a chemical element in a sample.

BACKGROUND OF THE DISCLOSURE

Since the early development of accelerator mass spectrometry in 1977, accelerator mass spectrometers developed into a mature analytic tool for the measurement of extremely low concentrations of long-lived radio-isotopes. Best examples of radio-isotopes that found their application in research fields like archeology, geoscience, environmental science and biomedicine, include $^{3}H$, $^{10}Be$, $^{14}C$, $^{26}Al$, $^{36}Cl$, $^{41}Ca$, $^{59}Ni$, $^{129}I$ and $^{239}Pu$.

Historically, the vast majority of accelerators used in accelerator mass spectrometry are tandem accelerators. Although other types of accelerators are sometimes applied, including single-ended accelerators, cyclotrons and linear accelerators, tandem accelerators are the first choice because of their widespread availability, versatility and the high precision that can be achieved with these accelerators.

Known accelerator mass spectrometry systems that use a tandem accelerator comprise an ion source, in which atoms from solid or gaseous sample material are negatively ionized. The negative ions are extracted from the ion source in an electrostatic field region and form a stream of ions, referred to as "ion beam". The extracted negative ion beam contains the various isotopes of the element of interest. Usually, one of these isotopes is a long-lived radioisotope having an extremely low natural abundance, typically $10^{10}$ to $10^{16}$ times lower than the stable isotopes. For some elements, including carbon, several stable isotopes are present. Such stable isotope(s) are usually measured in a Faraday cup(s) with intensities of nano-amperes or micro-amperes. However, the concentration of radioisotopes is usually so low that individual ions of these isotopes are commonly counted one after another using a suitable particle detector.

Current systems available on the market include dedicated systems tailored for only one radioisotope (mostly $^{14}C$) as well as versatile systems that are capable of analyzing a variety of different radioisotopes with the same instrument. Despite the fact that these systems are carefully designed (they often comprise multiple filter stages, each separating specific interferences from the radioisotope of interest), it is very well possible that unintentionally other particles than the radioisotope of interest make it into the particle detector where they mimic the radioisotopes and increase the background level of the instrument. Since the concentration ratio between a radioisotope and a stable isotope can be as low as $10^{-16}$, it is required that current systems perform very well in term of analysis precision and background level reduction.

Reducing the background level of the instrument can be realized by adding one or more filter stages to the system. However, by doing so, costs, complexity and footprint of the accelerator mass spectrometry system are significantly increased.

SUMMARY OF THE DISCLOSURE

It is therefore an object of the invention to provide an accelerator mass spectrometry system that effectively reduces background level in an efficient and cost-effective manner.

According to a first aspect, the invention provides hereto an accelerator mass spectrometry system according to the preamble of claim 1, characterized by an additional analyzer located in between the charge stripping section and the second accelerating section, which is configured to receive positive ions that have exited the charge stripping section and to separate positive ions having a charge state corresponding to a predetermined charge-state value from positive ions having a charge state not corresponding to the predetermined charge-state value, so as to transmit ions with different charge states in mutually different directions such that only ions having a charge state corresponding to the predetermined charge-state value are transmitted towards the particle detector. In this way, the additional analyzer serves as a charge-state selector, in which interfering ions, i.e. background-level increasing ions, that have a different charge-state than that of the first and second isotopes, i.e. the isotopes of interest, have a different bending radius and are consequently swept out of the path of the isotopes of interest. Because the relative difference between the two charge states, e.g. 1+ versus 2+, or 2+ versus 3+, et cetera, is large, the bending angle of additional analyzer may be relatively small in comparison to other analyzers in the accelerator mass spectrometry system, while still providing the required background reduction. The reason for this is that the other analyzers of the accelerator mass spectrometry system need to resolve one isotope from the other, which is a relative small difference and therefore requires a larger bending angle compared to mere charge-state selection. The location of the additional analyzer between the charge stripping section and the second acceleration section is optimal, since this is the only location where the interfering ions that need to be suppressed can be relatively easily discriminated from the first and second isotopes, i.e. the isotopes of interest. As a result, the additional analyzer, being a small analyzer having a small bending angle located in between the charge stripping section and the second accelerating section, is capable of effectively reducing the background level of the accelerator mass spectrometry system, while keeping an increase in costs, complexity and footprint of the system small.

In a preferred embodiment, the accelerator mass spectrometry system further comprises a Faraday cup configured to measure a quantity of ions of only one of the first and second isotopes, said one of the first and second isotopes being different from the one of the first and second isotopes that enter the particle detector. In this way, an isotopic ratio between a radioisotope and a stable isotope of a chemical element of interest in a sample can be determined by measuring ions of the stable isotope in the Faraday cup with intensities of nano-amperes or micro-amperes, while measuring individual ions of the radioisotope with the particle detector. The isotopic ratio can subsequently be determined from the measurement data of the Faraday cup and the measurement data of the particle detector. Preferably, the Faraday cup is arranged after the second mass analyzer.

In a preferred embodiment, the additional analyzer comprises a magnetic analyzer or an electrostatic analyzer. Essentially, both magnetic and electrostatic versions of the additional analyzer will be equally suitable as long as they provide different bending radii for the different charge-states. Preferably, the magnetic analyzer comprises a dipole magnet and the electrostatic analyzer comprises an electrostatic deflector.

In a preferred embodiment, the dipole magnet and the electrostatic deflector have a bending angle of 30 degrees or less. In the case that the additional analyzer is in the form of a dipole magnet, the additional analyzer will have slight different bending radii for the different isotopes of interest, which asks for a careful design of the second mass analyzer and the subsequent Faraday cups. Since the required bending angle of the additional analyzer can be relatively small and at the same time eliminates the dominant contribution to the background, it provides an efficient and cost-effective manner to surpass limitations on background interference of existing instrumentation. Preferably, the bending angle is between 5 and 20 degrees. More preferably, the bending angle is approximately 12 degrees.

In a preferred embodiment, the accelerator mass spectrometry system is configured for a measurement of a quantity of radiocarbon in the sample, wherein the additional analyzer is configured to select charge state 1+. In this specific configuration adapted to the measurement of radiocarbon (i.e. $^{14}C$) using charge state 1+, the bending angle can be smaller than 30 degrees, or even as small as approximately 12 degrees, so that the accelerator mass spectrometry system is eminently suitable for such measurement. Such bending angles are sufficiently large to effectively remove the otherwise interfering ions. The accelerator mass spectrometry system therewith provides an efficient and cost-effective tool to surpass limitations on background interference of existing instrumentation.

According to a second aspect, the invention provides a method according to the preamble of claim 10, characterized by subjecting the positive ions that have exited the charge stripping section to an additional analyzer, located in between the charge stripping section and the second accelerating section, to separate positive ions having a charge state corresponding to a predetermined charge-state value from positive ions having a charge state not corresponding to the predetermined charge-state value, so as to transmit ions with different charge states in mutually different directions such that only ions having a charge state corresponding to the predetermined charge-state value are transmitted towards the particle detector. In this way, the additional analyzer serves as a charge-state selector, in which interfering ions, i.e. background-level increasing ions, that have a different charge-state than that of the first and second isotopes, i.e. the isotopes of interest, have a different bending radius and are consequently swept out of the path of the isotopes of interest. Because the relative difference between the two charge states, e.g. 1+ versus 2+, or 2+ versus 3+, et cetera, is large, the bending angle of additional analyzer may be relatively small in comparison to other analyzers in the accelerator mass spectrometry system, while still providing the required background reduction. The reason for this is that the other analyzers of the accelerator mass spectrometry system need to resolve one isotope from the other, which is a relative small difference and therefore requires a larger bending angle compared to mere charge-state selection. The location of the additional analyzer between the charge stripping section and the second acceleration section is optimal, since this is the only location where the interfering ions that need to be suppressed can be relatively easily discriminated from the first and second isotopes, i.e. the isotopes of interest. As a result, the additional analyzer, being a small analyzer having a small bending angle located in between the charge stripping section and the second accelerating section, is capable of effectively reducing the background level of the accelerator mass spectrometry system, while keeping an increase in costs, complexity and footprint of the system small.

In a preferred embodiment, the method further comprises a step of measuring a second quantity of ions of only one of the first and second isotopes, said one of the first and second isotopes being different from the one of the first and second isotopes that enter the particle detector. In this way, an isotopic ratio between a radioisotope and a stable isotope of a chemical element of interest in a sample can be determined from a measurement of a quantity of ions of the stable isotope and a measurement of a quantity of ions of the radioisotope.

In a preferred embodiment, the step of measuring the second quantity is performed after the second mass analyzer. Essentially, both magnetic and electrostatic versions of the additional analyzer will be equally suitable as long as they provide different bending radii for the different charge-states. Preferably, the magnetic analyzer comprises a dipole magnet and the electrostatic analyzer comprises an electrostatic deflector.

In a preferred embodiment, the step of separating positive ions having a predetermined charge state from positive ions having a charge state corresponding to a predetermined charge-state value from positive ions having a charge state different from the predetermined charge-state value comprises deflecting particle trajectories of the positive ions over a bending angle of 30 degrees or less. In the case that additional analyzer is in the form of a dipole magnet, the additional analyzer will have slight different bending radii for the different isotopes of interest, which asks for a careful design of the second mass analyzer and the subsequent Faraday cups. Since the required bending angle of the additional analyzer can be relatively small and at the same time eliminates the dominant contribution to the background, it provides an efficient and cost-effective manner to surpass limitations on background interference of existing instrumentation. Preferably, the bending angle is between 5 and 20 degrees. More preferably, the bending angle is approximately 12 degrees.

In a preferred embodiment, the method steps are configured to measure a quantity of radiocarbon in the sample, wherein the step of separating positive ions having a charge state corresponding to a predetermined charge-state value from positive ions having a charge state different from the predetermined charge-state value is configured to select charge state 1+. In this specific configuration adapted to the measurement of radiocarbon (i.e. $^{14}C$) using charge state 1+, the bending angle can be smaller than 30 degrees, or even as small as approximately 12 degrees, so that the method is eminently suitable for such measurement. Such bending angles are sufficiently large to effectively remove the otherwise interfering ions. The method therewith provides an efficient and cost-effective manner to surpass limitations on background interference of existing instrumentation.

BRIEF DESCRIPTION OF THE DRAWINGS

The present invention is further elucidated on the basis of the following figures which show preferred embodiments thereof and are not intended to limit the scope of protection of the invention in any way, wherein.

DETAILED DESCRIPTION

Figure 1:
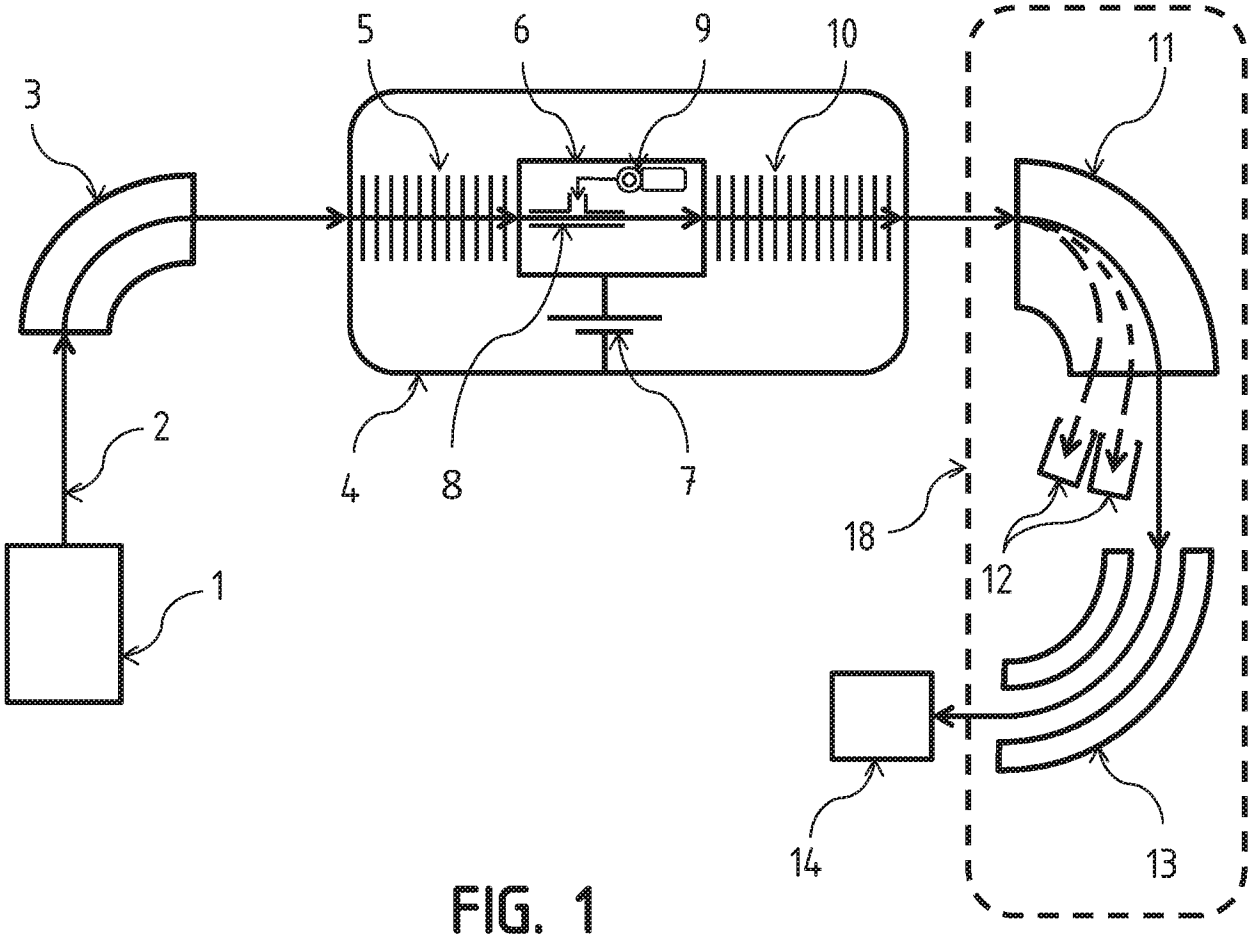
FIG. 1 shows a schematic layout of an accelerator mass spectrometry system known from prior art.

Referring to FIG. 1, a solid or gaseous sample under investigation is introduced into an ion source 1. In the ion source at least part of the sample material is ionized into the negative charge state. In an electrostatic field region, the negative ions are extracted from the ion source to form a negative ion beam 2. The isotopes of interest are then selected in a cyclic fashion by a first mass analyzer 3 in which each isotope is selected after the other for a specific duration for further transport into the tandem accelerator 4. In a first accelerating section 5 of the tandem accelerator 4, the ions are accelerated towards a high-voltage terminal 6 that is maintained at a positive potential by a high-voltage power supply 7. In the terminal, the ions are directed through a so called stripper 8 that consists of a tube into which a small amount of gas is admitted from a gas supply system 9. In the stripper 8 the gas pressure is relatively high and the incoming negative ions are charge-exchanged to a singly or multiply positive charge state by interaction with the gas atoms or molecules. The stripper 8 not only serves to charge-exchange the incoming ions into a positive charge state, but also serves to dissociate or break-up molecules that could otherwise mimic the isotopes of interest, thereby contributing to the background level of the instrument.

After the charge-exchange in the stripper, the positive ions are accelerated back towards ground potential in a second acceleration section 10, after which they leave the tandem accelerator towards a second analyzer section 18, comprising a second mass analyzer 11 and an electrostatic analyzer 13. The second mass analyzer 11 directs e.g. the stable isotope ions into individual Faraday cups 12, whereas e.g. the radioisotope ions are subsequently further analyzed in the electrostatic analyzer 13. The electrostatic analyzer 13 serves to exclusively transmit those ions with the correct energy-to-charge ratio, thereby blocking those interfering ions that have unintentionally passed the second mass analyzer. Finally, the ions enter a particle detector 14 that discriminates, within limits, between bona-fide radioisotopes of interest and interfering ions. However, its resolving power is limited and therefore some interfering ions may be incorrectly identified as bona-fide radioisotope particles.

Finally, the data acquisition of the accelerator mass spectrometry system collects the data from the Faraday cups 12 and the particle detector 14 and from this the isotopic ratio is determined.

Figure 2:
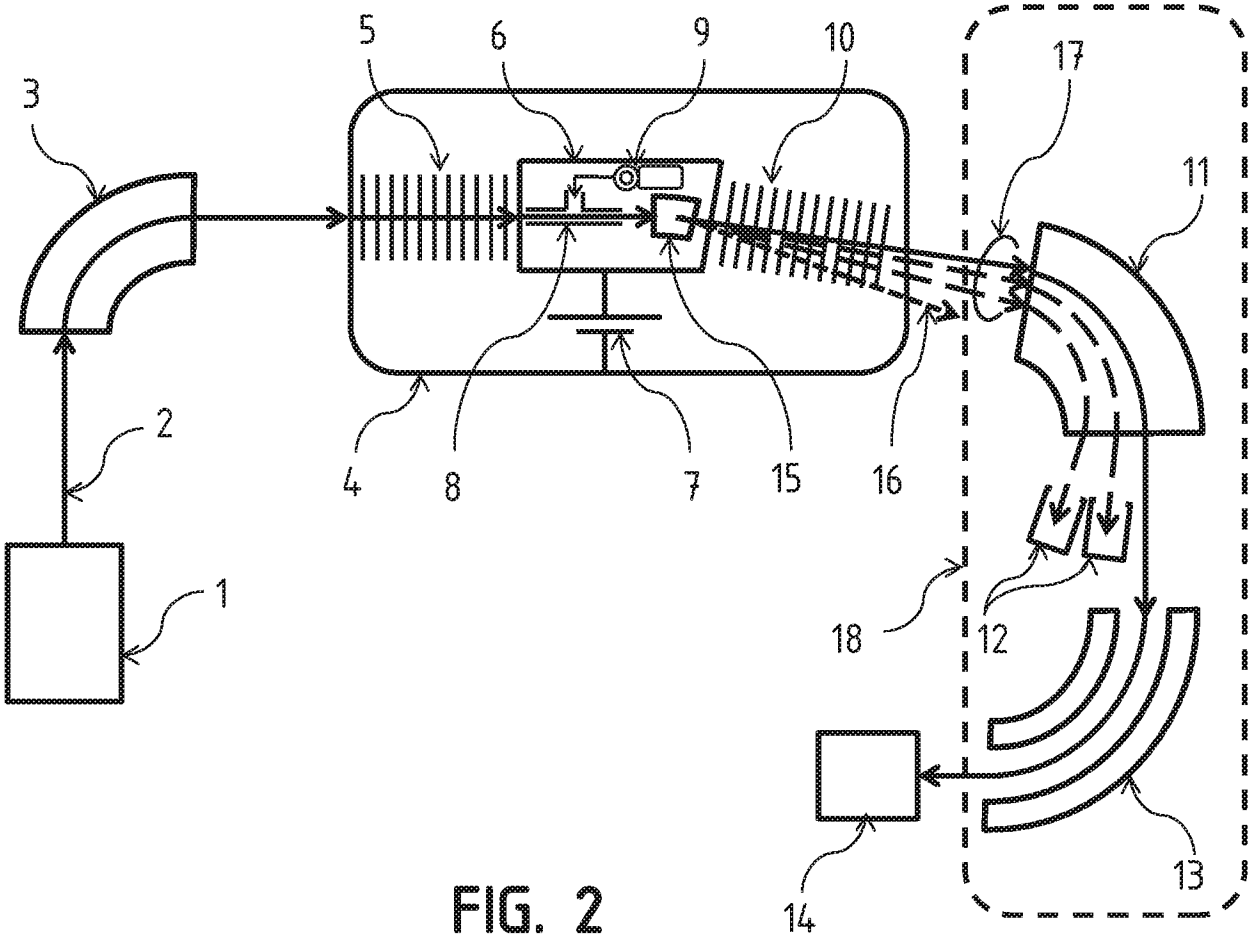
FIG. 2 shows a schematic layout of a preferred embodiment of the accelerator mass spectrometry system according to the invention.

In contrast to the instrument of FIG. 1, the instrument of FIG. 2 has an additional analyzer 15 located in the high-voltage terminal 6 of the accelerator 4, after the stripper 8, but before the second acceleration section 10. Furthermore, it is noted that there are many variations possible on the details of the systems described above and the sequence of the analyzers/filters in the system. For instance, the position of the second mass analyzer 11 and the position of the electrostatic analyzer 13 may be interchanged in the accelerator mass spectrometry system according to a preferred embodiment of the invention as shown in FIG. 2.

The additional analyzer 15 serves as a charge-state selector, in which interfering ions 16 that have a different charge-state than that of an isotope of interest, such as a radioisotope, have a different bending radius and are consequently swept out of the path of the isotopes of interest 17.

In particular, the additional analyzer 15 enables improving accelerator mass spectrometry system performance in terms of background level in measurements of radiocarbon quantities. A known and cumbersome background source in the measurement of radiocarbon (i.e. $^{14}C$) quantities results from the injection of the interfering molecule of $^{13}CH^-$ into the tandem accelerator 4, along with the wanted $^{14}C^-$. In the stripping process, the $^{13}CH^-$ is dissociated and charge-exchanged into a positive charge state. A background problem arises when the charge state of the $^{13}C$ is one unit higher (for example 2+, instead of the 1+) than that of the $^{14}C$ of interest and a subsequent unintended charge-exchange from 2+ to 1+ of the $^{13}C$ ions takes place at a very specific location inside the second acceleration section 10. This may result in an energy of the $^{13}C$ ions that is a little higher than the reference $^{14}C$ ions so that the $^{13}C$ interfering ions follow essentially the same path in the second mass analyzer 11 as the $^{14}C$ of interest. Although the electrostatic analyzer 13 that follows is designed to block such interferences that have incorrect energy, its resolving power is insufficient to suppress the interfering $^{13}C$ completely. It is known that by just one single scattering event on one of the electrodes of the electrostatic analyzer 13 a very small but noticeable fraction of the interfering $^{13}C$, in the order of $10^{-5}$, can reach the particle detector 14, adding to the background level. A comparable interference arises when the unintended charge-exchange from 2+ to 1+ of the $^{13}C$ takes place at a different, but again a very specific location inside the second acceleration section 10, in which case it is the second mass analyzer 11 that has insufficient resolving power to suppress the interfering $^{13}C$ completely.

The class of background described above is characterized in that it originates from particles that leave the stripper 8 having a charge state that is one unit higher than that of the radioisotope of interest in combination with a charge-exchange of the corresponding particle in the second acceleration section 10. It is generally accepted that this class of background is the main contributor to the overall background level of today's $^{14}C$ analyzing accelerator mass spectrometry systems. The additional analyzer 15 directly behind the stripper 8 enables sweeping out interfering $^{13}C$ ions that have a different charge-state than that of $^{14}C$ from the path of the $^{14}C$ ions due to the bending radius of the $^{13}C$ ions being different from the bending radius of the $^{14}C$ ions, because of their different charge state.

Because the relative difference between the two charge states, e.g. 1+ versus 2+, or 2+ versus 3+, et cetera, is large, the bending angle of additional analyzer 15 may be relatively small in comparison to other analyzers in the accelerator mass spectrometry system, while still providing the required background reduction. The reason for this is that the other analyzers need to resolve one isotope from the other, which is a relative small difference and therefore requires a larger bending angle compared to mere charge-state selection. The location of the additional analyzer 15 between the stripper 8 and second acceleration section 10 is optimal, since this is the only location where the interfering ions that need to be suppressed can be relatively easily discriminated from the isotope of interest. As a result, a compact additional analyzer 15 having a small bending angle located in between the stripper 8 and the second accelerating section 10 is capable of effectively reducing the background level of the accelerator mass spectrometry system, while keeping an increase in costs, complexity and footprint of the system small.

The additional analyzer 15 can be in the form of a magnetic analyzer or dipole magnet, or alternatively in the form of an electrostatic analyzer. Both magnetic and electrostatic versions of the additional analyzer 15 will be essentially equally suitable as long as they provide different bending radii for the different charge-states. The bending angle of the additional analyzer 15 should be sufficiently large to effectively remove the otherwise interfering ions 16. In practice and in the case of an accelerator mass spectrometry system that is specifically designed for $^{14}C$ analysis using charge state 1+, it turns out that the bending angle can be smaller than 30 degrees, or even as small as approximately 12 degrees. In the case that additional analyzer 15 is in the form of a dipole magnet, the additional analyzer 15 will have slight different bending radii for the different isotopes of interest 17, which is also indicated in FIG. 2, and this asks for a careful design of the second mass analyzer 11 as well as the subsequent the Faraday cups 12. Since the required bending angle of the additional analyzer 15 can be relatively small and at the same time eliminates the dominant contribution to the background, it provides an efficient and cost-effective manner to surpass limitations on background interference of existing instrumentation.

The present invention is by no means limited to the above described preferred embodiments thereof. The rights claimed are determined by the appended claims within the scope of which many modifications are conceivable.

The invention claimed is:

1. An accelerator mass spectrometry system for measuring an isotopic ratio of a chemical element in a sample, comprising:

an ion source for generating a beam of negative ions of the chemical element containing ions of a first isotope and ions of a second isotope, being different from the first isotope, of the chemical element;

a first analyzer section, comprising a first mass analyzer configured to separate negative ions having a mass corresponding to a first predetermined value from negative ions having a mass not corresponding to the first predetermined value, such that only negative ions having a mass corresponding to the first predetermined value are transmitted;

a tandem accelerator configured to receive the negative ions that have been transmitted by the first mass analyzer, the tandem accelerator comprising:

a first accelerating section configured to accelerate the negative ions and to direct them through a charge stripping section for converting the negative ions into positive ions, and a second accelerating section behind the charge stripping section configured to accelerate the positive ions;

a second analyzer section arranged downstream of the tandem accelerator, comprising:

a second mass analyzer configured to separate positive ions having a mass corresponding to a second predetermined value from positive ions having a mass not corresponding to the second predetermined value, such that only positive ions having a mass corresponding to the second predetermined value are transmitted, and an electrostatic analyzer configured to separate positive ions having an energy-to-charge ratio corresponding to a third predetermined value from positive ions having an energy-to-charge ratio not corresponding to the third predetermined value, such that only positive ions having an energy-to-charge ratio corresponding to the third predetermined value are transmitted;

a particle detector configured to receive the positive ions that have been transmitted by the second analyzer section and configured to measure a quantity of ions; and a controller system configured to control the first mass analyzer section and the second analyzer section such that the ions of the first and second isotopes traverse the tandem accelerator and ions of only one of the first and second isotopes enter the particle detector, wherein an additional analyzer is located in between the charge stripping section and the second accelerating section, the additional analyzer configured to receive positive ions that have exited the charge stripping section and to separate positive ions having a charge state corresponding to a predetermined charge-state value from positive ions having a charge state not corresponding to the predetermined charge-state value, so as to transmit ions with different charge states in mutually different directions such that only ions having a charge state corresponding to the predetermined charge-state value are transmitted towards the particle detector.

2. The accelerator mass spectrometry system in accordance with claim 1, further comprising a Faraday cup configured to measure a quantity of ions of only one of the first and second isotopes, said one of the first and second isotopes being different from the one of the first and second isotopes that enter the particle detector.

3. The accelerator mass spectrometry system in accordance with claim 2, wherein the Faraday cup is arranged after the second mass analyzer.

4. The accelerator mass spectrometry system in accordance with claim 1, wherein the additional analyzer comprises a magnetic analyzer or an electrostatic analyzer.

5. The accelerator mass spectrometry system in accordance with claim 4, wherein the magnetic analyzer comprises a dipole magnet and the electrostatic analyzer comprises an electrostatic deflector.

6. The accelerator mass spectrometry system in accordance with claim 5, wherein the dipole magnet and the electrostatic deflector have a bending angle of 30 degrees or less.

7. The accelerator mass spectrometry system in accordance with claim 6, wherein the bending angle is between 5 and 20 degrees.

8. The accelerator mass spectrometry system in accordance with claim 7, wherein the bending angle is approximately 12 degrees.

9. The accelerator mass spectrometry system in accordance with claim 1, wherein the accelerator mass spectrometry system is configured for a measurement of a quantity of radiocarbon in the sample, wherein the additional analyzer is configured to select charge state 1+.

10. A method for measuring an isotopic ratio of a chemical element in a sample, comprising:

generating a beam of negative ions of the chemical element containing ions of a first isotope and ions of a second isotope, being different from the first isotope, of the chemical element;

subjecting the beam to a first analyzer section, comprising a first mass analyzer to separate negative ions having a mass corresponding to a first predetermined value from negative ions having a mass not corresponding to the first predetermined value, such that only negative ions having a mass corresponding to the first predetermined value are transmitted;

subjecting the negative ions that have been transmitted by the first mass analyzer to a tandem accelerator accelerating the negative ions by a first accelerating section, directing them through a charge stripping section for converting the negative ions into positive ions, and accelerating the positive ions by a second accelerating section;

downstream of the tandem accelerator, subjecting the positive ions to a second analyzer section comprising a second mass analyzer to separate positive ions having a mass corresponding to a second predetermined value from positive ions having a mass not corresponding to the second predetermined value, such that only positive ions having a mass corresponding to the second predetermined value are transmitted, and an electrostatic analyzer to separate positive ions having an energy-to-charge ratio corresponding to a third predetermined value from positive ions having an energy-to-charge ratio not corresponding to the third predetermined value, such that only positive ions having an energy-to-charge ratio corresponding to the third predetermined value are transmitted;

directing the positive ions that have been transmitted by the second analyzer section towards a particle detector and detecting the positive ions to measure a first quantity of ions;

controlling the first mass analyzer section and the second analyzer section such that the ions of the first and second isotopes traverse the tandem accelerator and ions of only one of the first and second isotopes enter the particle detector, and subjecting the positive ions that have exited the charge stripping section to an additional analyzer located between the charge stripping section and the second accelerating section, to separate positive ions having a charge state corresponding to a predetermined charge-state value from positive ions having a charge state not corresponding to the predetermined charge-state value, so as to transmit ions with different charge states in mutually different directions such that only ions having a charge state corresponding to the predetermined charge-state value are transmitted towards the particle detector.

11. The method in accordance with claim 10, further comprising a step of measuring a second quantity of ions of only one of the first and second isotopes, said one of the first and second isotopes being different from the one of the first and second isotopes that enter the particle detector.

12. The method in accordance with claim 11, wherein the step of measuring the second quantity is performed after the second mass analyzer.

13. The method in accordance with claim 10, wherein the step of separating positive ions having a charge state corresponding to a predetermined charge-state value from positive ions having a charge state different from the predetermined charge-state value comprises deflecting particle trajectories of the positive ions over a bending angle of 30 degrees or less.

14. The method in accordance with claim 13, wherein the bending angle is between 5 and 20 degrees.

15. The method in accordance with claim 14, wherein the bending angle is approximately 12 degrees.

16. The method in accordance with claim 10, wherein the method steps are configured to measure a quantity of radiocarbon in the sample, wherein the step of separating positive ions having a charge state corresponding to a predetermined charge-state value from positive ions having a charge state different from the predetermined charge-state value is configured to select charge state 1+.

* * * * *